United States Patent [19]

Simpson

[11] Patent Number: 4,469,126

[45] Date of Patent: Sep. 4, 1984

[54] DISCHARGE VALVE ASSEMBLY FOR REFRIGERATION COMPRESSORS

[75] Inventor: Francis M. Simpson, Sidney, Ohio

[73] Assignee: Copeland Corporation, Sidney, Ohio

[21] Appl. No.: 318,055

[22] Filed: Nov. 4, 1981

[51] Int. Cl.[3] ..... F16K 21/04

[52] U.S. Cl. ..... 137/543.19; 417/569

[58] Field of Search ..... 137/543.19, 533.19, 137/514.5, 535, 540, 528, 529, 533, 532; 417/567, 569, 559, 564

[56] References Cited

U.S. PATENT DOCUMENTS

| | | |
|---|---|---|
| 310,459 | 1/1865 | Nicholson et al. . |
| 367,726 | 8/1887 | Penney . |
| 512,369 | 1/1894 | Garis et al. . |
| 520,349 | 5/1894 | Zies . |
| 542,083 | 7/1895 | De Laval . |
| 955,822 | 4/1910 | Mayhew . |
| 976,010 | 11/1910 | Thompson . |
| 1,109,154 | 9/1914 | Thomas . |
| 1,185,412 | 5/1916 | Kramer . |
| 1,287,751 | 12/1918 | Richards . |
| 1,407,518 | 2/1922 | Dennedy . |
| 1,425,663 | 8/1922 | Lawhead . |
| 1,467,445 | 9/1923 | Meyers et al. . |
| 1,476,794 | 12/1923 | Berry . |
| 1,490,141 | 4/1924 | Stoms . |
| 1,494,834 | 5/1924 | Hack . |
| 1,514,233 | 11/1924 | Searles et al. . |
| 1,628,096 | 5/1927 | Worth . |
| 1,652,978 | 12/1927 | Enock . |
| 1,659,817 | 2/1928 | Halvorsen . |
| 1,719,572 | 7/1929 | Stoll . |
| 1,800,185 | 4/1931 | Thrush . |
| 1,871,285 | 8/1932 | Tursky . |
| 1,976,098 | 10/1934 | Smith . |
| 1,985,841 | 12/1934 | Shepherd . |
| 2,025,240 | 12/1935 | Higham . |
| 2,193,243 | 3/1940 | Teeter . |
| 2,349,137 | 5/1944 | Brown . |
| 2,358,950 | 9/1944 | Trautman . |
| 2,359,486 | 10/1944 | Magis . |

(List continued on next page.)

FOREIGN PATENT DOCUMENTS

| | | |
|---|---|---|
| 144437 | 4/1950 | Australia . |
| 681798 | 3/1964 | Canada . |
| 452903 | 11/1927 | Fed. Rep. of Germany . |
| 1080350 | 4/1960 | Fed. Rep. of Germany . |
| 1503428 | 4/1969 | Fed. Rep. of Germany . |
| 1550254 | 7/1969 | Fed. Rep. of Germany . |
| 2426378 | 1/1975 | Fed. Rep. of Germany . |
| 940160 | 12/1948 | France . |
| 2100429 | 3/1972 | France . |
| 2366465 | 4/1978 | France . |
| 679079 | 9/1952 | United Kingdom . |
| 697495 | 9/1953 | United Kingdom . |
| 905661 | 9/1962 | United Kingdom . |
| 988894 | 4/1965 | United Kingdom . |
| 995929 | 6/1965 | United Kingdom . |
| 1015412 | 12/1965 | United Kingdom . |
| 1090740 | 11/1967 | United Kingdom . |
| 1199523 | 7/1970 | United Kingdom . |
| 1265497 | 3/1972 | United Kingdom . |
| 1350287 | 4/1974 | United Kingdom . |
| 1374783 | 11/1974 | United Kingdom . |

OTHER PUBLICATIONS

Excerpt from "Machine Design", (U.S.), vol. 42, p. 146, Nov. 12, 1970.

"A Look At Problem-Solving with Custom-Made Vespel Parts made by DuPont from high performance engineering resins".

*Primary Examiner*—Alan Cohan
*Assistant Examiner*—John A. Rivell
*Attorney, Agent, or Firm*—Harness, Dickey & Pierce

[57] ABSTRACT

An improved discharge valve assembly is disclosed for use in refrigeration compressors which includes a combination valve guide and spring retainer extending into a conical discharge gas passage and which includes an annular conical surface positioned in spaced parallel relationship with the sidewalls defining the discharge gas passage. The conical annular surface cooperates with the sidewalls defining the discharge gas passage to provide a diffusing discharge gas flowpath offering improved compression efficiency and sound reduction.

10 Claims, 3 Drawing Figures

U.S. PATENT DOCUMENTS

| | | | |
|---|---|---|---|
| 2,366,004 | 12/1944 | Crittenden . | |
| 2,386,726 | 10/1945 | Tannehill . | |
| 2,579,667 | 12/1951 | Hanson . | |
| 2,900,999 | 8/1959 | Courtot . | |
| 2,930,401 | 3/1960 | Cowan . | |
| 2,949,929 | 8/1960 | Moore . | |
| 3,229,864 | 1/1966 | Roder . | |
| 3,332,437 | 7/1967 | Hallen . | |
| 3,378,030 | 4/1968 | Cary | 137/543.19 |
| 3,548,868 | 12/1970 | Mullaney . | |
| 3,664,371 | 5/1972 | Schneider . | |
| 3,770,009 | 11/1973 | Miller . | |
| 3,889,710 | 6/1975 | Brost . | |
| 3,898,999 | 8/1975 | Haller . | |
| 3,944,381 | 3/1976 | Dirk . | |
| 3,999,898 | 12/1976 | Chomczyk . | |
| 4,032,266 | 6/1977 | Roeder . | |
| 4,049,017 | 9/1977 | Jones . | |
| 4,060,098 | 11/1977 | Bares et al. . | |

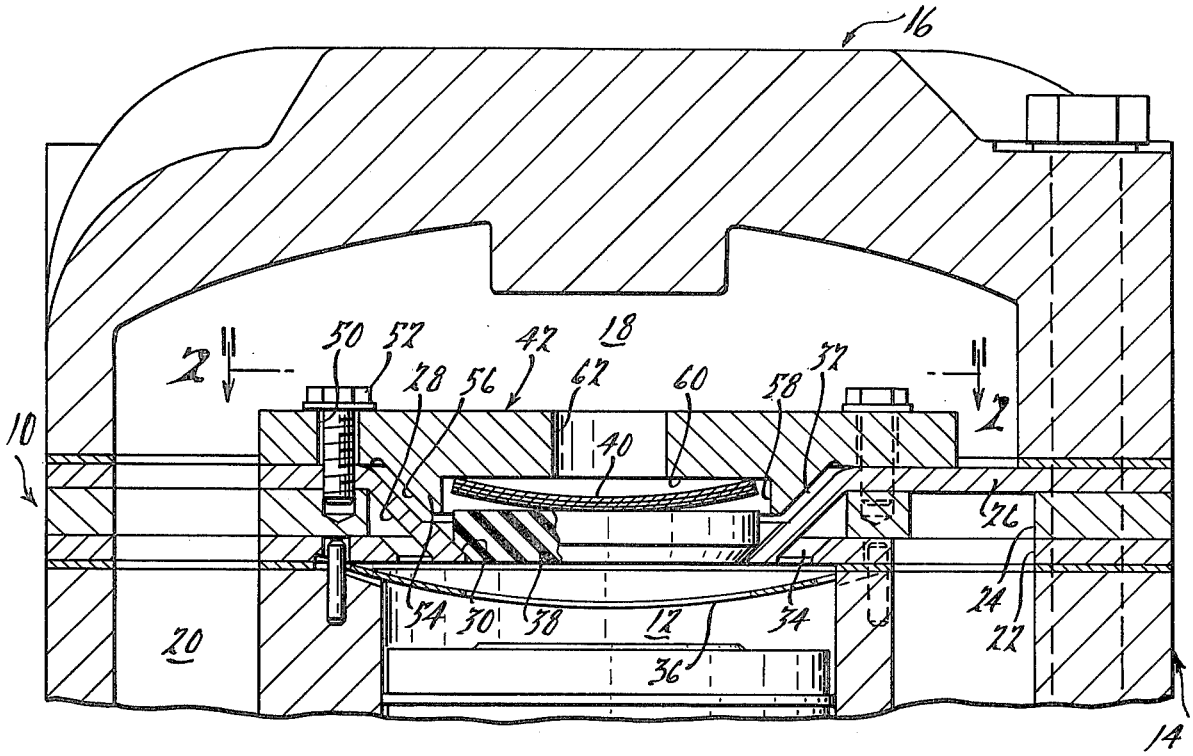
FIG. 1.
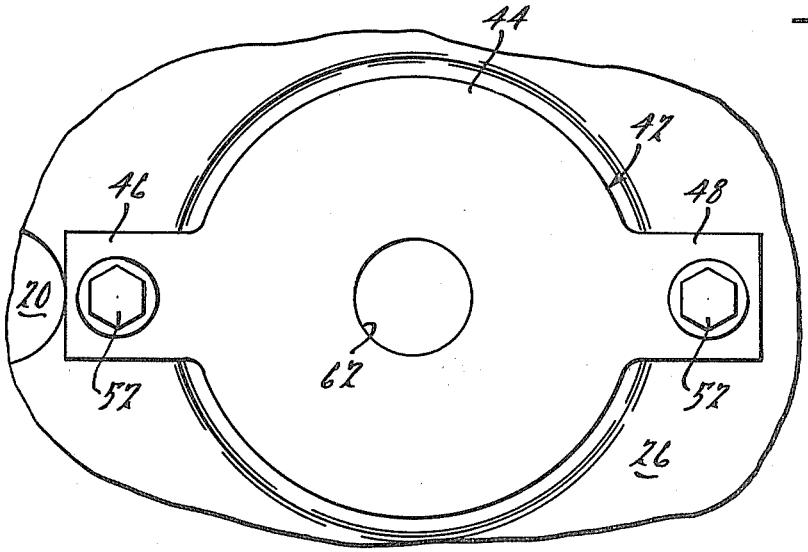
FIG. 2.
FIG. 3.
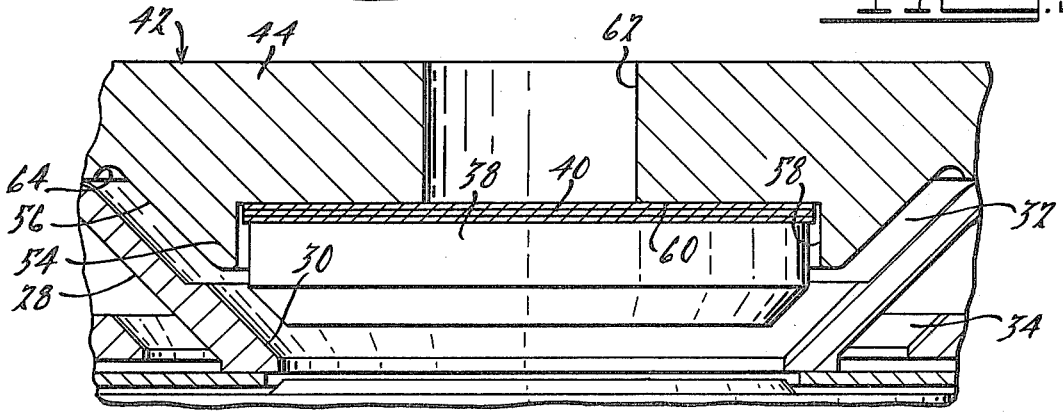

DISCHARGE VALVE ASSEMBLY FOR REFRIGERATION COMPRESSORS

BACKGROUND AND SUMMARY OF THE INVENTION

The present invention relates generally to pressure responsive compressor valve assemblies and more particularly to such assemblies employing disc type valve members and particularly adapted for use on refrigeration compressors.

The present invention is particularly well suited for use in combination with the disc-like lightweight valves of the type disclosed in assignee's copending application Ser. No. 971,309, filed Dec. 20, 1978, now abandoned in favor of continuation application Ser. No. 219,849, filed Dec. 23, 1980 now U.S. Pat. No. 4,368,755, and assignee's copending application Ser. No. 318,155, entitled "Discharge Valve Assembly For Refrigeration Compressors" filed of even date herewith and the head and valve plate assemblies disclosed in assignee's copending application Ser. No. 114,346, filed Jan. 22, 1980 and assignee's copending application Ser. No. 318,052, entitled "Valve Plate Assembly For Refrigeration Compressors" filed of even date herewith and represents an alternative to the bridge assemblies disclosed in assignee's copending application Ser. No. 114,345, filed Jan. 22, 1980 and the valve guide of assignee's copending application Ser. No. 234,169, filed Feb. 13, 1981. It is also well suited for use with the leaf spring biasing arrangement disclosed in assignee's copending application Ser. No. 234,343, filed Feb. 13, 1981 now abandoned in favor of application Ser. No. 318,053, filed Nov. 4, 1981. It may be used in both rotary and other types of compressors including single and multi-cylinder reciprocating piston type compressors of either hermetic or accessible hermetic type.

Valve plates and cylinder head assemblies can become relatively complex in configuration for certain valve arrangements and as a result may be quite costly to manufacture and sometimes to assemble.

The present invention provides an improved valve assembly which includes a combination discharge valve guide and spring support member and discharge gas diffuser. The discharge gas diffuser is generally conical in shape being positioned in the discharge opening provided in the valve plate and has been found to offer improved performance characteristics both in terms of noise reduction and operating efficiency. It is believed that this improvement in performance is due to the improved flowpath through the discharge opening created by the diffuser/valve guide and spring support member.

Additional advantages and features of the present invention will become apparent from the subsequent description and the appended claims taken in conjunction with the accompanying drawings.

BRIEF DESCRIPTION OF THE DRAWINGS

FIG. 1 is a fragmentary section view of a portion of a refrigeration compressor showing a valve plate assembly including the combination diffuser valve guide and spring support member installed thereon, all in accordance with the present invention;

FIG. 2 is an enlarged fragmentary view of the valve plate assembly of FIG. 1, the view being taken along line 2—2 of FIG. 1; and FIG. 3 is an enlarged fragmentary section view of the valve plate assembly of FIG. 1 with the discharge valve shown in an open position.

DESCRIPTION OF THE PREFERRED EMBODIMENT

Referring now to the drawings and in particular to FIG. 1, there is shown a valve plate assembly 10 secured in overlying relationship to a cylinder 12 of a reciprocating piston type compressor 14. A head 16 is also secured in overlying relationship to valve plate assembly 10 and has a discharge chamber 18 provided therein for conducting compressed discharge gases to discharge passage 20.

Valve plate assembly 10 comprises a lower valve plate 22, a center plate 24 and an upper valve plate 26. The upper valve plate 26 includes a generally conical depending portion 28, the upper surface of which defines a discharge valve seat 30 and a discharge passage 32 and the lower surface of which cooperates with a conical opening in lower valve plate to define a suction gas inlet opening 34. A ring type suction valve 36 (shown in an open position in FIG. 1) is provided to close off the suction gas inlet opening 34 to cylinder 12 and a generally conically shaped discharge valve member 38 is shown being biased into engagement with valve seat 30 by a leaf spring 40 engaging the upper surface thereof.

The valve assembly thus far described is substantially identical to that disclosed in assignee's copending application Ser. No. 318,052, entitled "Valve Plate Assembly For Refrigeration Compressors" and filed of even date herewith and leaf spring 40 is of the type disclosed in assignee's copending application Ser. No. 243,343, filed Feb. 13, 1981, the disclosures of which are hereby incorporated by reference. Preferably, discharge valve 38 will be of the type disclosed in assignee's copending application Ser. No. 219,849 filed Dec. 23, 1980 although the discharge valve disclosed in assignee's copending application Ser. No. 318,155, entitled "Discharge Valve Assembly For Regrigeration Compressors" may also be used.

Valve plate assembly 10 also includes a one piece combination diffuser valve guide and spring support member 42. Member 42 has a generally cylindrical upper center portion 44 from which a pair of mounting arms 46 and 48 extend diametrically outward, each arm having an opening 50 adjacent the outer end thereof through which a threaded fastener 52 extends to secure member 42 to valve plate assembly 10. A generally concially shaped portion 54 depends generally coaxially into discharge passage 32 from cylindrical portion 44 having an outer surface 56 positioned in opposed relationship with and at least coextensive with the conical surface portion of upper valve plate 26 defining discharge passage 32. A counterbore is provided in this depending conical portion to accommodate opening movement of discharge valve member 38 being defined by cylindrical sidewall 58 and upper stop surface 60. Preferably, conical portion 54 will extend into discharge passage 32 a distance sufficient to position cylindrical sidewall 58 of the counterbore in slightly overlapping position to the cylindrical sidewall portion of discharge valve 38 so as to provide a continuous annular guide surface for opening and closing movement of discharge valve 38. Upper stop surface 60 of counterbore provides a support for leaf spring 40 and also acts to limit opening movement of discharge valve 38. A center passage 62 is also provided opening into the counterbore through surface 60 so as to vent the counterbore during opening and closing movement of valve member 38.

In a preferred embodiment, both surface 56 and the conical surface portion of valve plate 26 defining discharge passage 32 will be inclined at an angle of approximately 45 degrees to a plane defined by lower valve plate member 22. This angulation is preferable because it provides for a rate of increase in flow area or diffusion as the discharge gas travels through discharge passage 32 which closely approximates the generally preferred diffusion provided by a 10 degree parallel wall diffuser. It should also be noted that a slight relief groove or notch 64 is provided at the juncture of conical surface 56 and each of the diametrically opposed mounting arms 46 and 48. This groove or notch aids in the flow of the discharge gas through discharge gas passage 32 by placing the point of impact of discharge gas against the mounting arms at a location above that at which the discharge gas enters discharge chamber 18 thus inserting a substantially greater area for the gas flow to move around the supporting arms.

While it will be apparent that the preferred embodiment of the invention disclosed is well calculated to provide the advantages and features above stated, it will be appreciated that the invention is susceptible to modification, variation and change without departing from the proper scope or fair meaning of the subjoined claims.

I claim:

1. An improved valve plate assembly for use in a compressor having a compression chamber, said valve plate assembly comprising;

a valve plate adapted to be positioned in overlying relationship to said compression chamber, said valve plate having a conical discharge opening extending therethrough, an inner portion of the sidewall of said opening in part defining a valve seat;

a valve member movably disposed within said opening;

biasing means operative to urge said valve member into engagement with said valve seat; and diffusion means extending into said opening, said diffusion means including a generally conical surface positioned in said discharge opening spaced a given dimension from said sidewall of said opening and cooperating with said sidewall to define an annular conical diffusion discharge passage therebetween having a length greater than said given dimension, said diffusion discharge passage forming a continuation of the flowpath between said valve member and valve seat when said valve member is in an open position.

2. A valve plate assembly as set forth in claim 1 wherein said depending portion extends a distance sufficient to slightly overlap the peripheral surface of said discharge valve when said discharge valve engages said valve seat.

3. An improved valve plate assembly for use in a compressor comprising:

a valve plate having a conical discharge opening extending therethrough, the sidewall of said opening in part defining a valve seat and in part a discharge gas passage;

a valve member movably disposed within said opening;

biasing means; and diffusion means secured to said valve plate, said diffusion means retaining said biasing means in engagement with said valve member whereby said biasing means is operative to bias said valve member into engagement with said valve seat to close said discharge opening, said diffusion means including a depending portion defined by a conical surface positioned in spaced relationship to said sidewall and extending inwardly from at least a plane defined by the outer surface of said valve plate and cooperating therewith to define a diffusion discharge gas flowpath therebetween, a pair of arms for securing said diffusion means to said valve plate and a notch provided at the juncture of said arms and said conical surface, said notch being operative to facilitate adjustment of the flow of discharge gas around said arms.

4. A valve plate assembly as set forth in claim 1 wherein said conical surface is positioned at an angle of approximately 45° relative to a plane defined by said valve plate.

5. A valve plate assembly as set forth in claim 1 wherein said conical surface is continuous around said depending portion.

6. A valve plate assembly as set forth in claim 1 wherein said diffusion means is positioned coaxial with said discharge opening.

7. A valve plate assembly as set forth in claim 1 wherein said diffusion means includes means defining a cylindrical surface concentrically disposed with respect to said conical surface and operative to guide movement of said discharge valve between open and closed positions.

8. A valve plate assembly as set forth in claim 7 wherein said diffusion means further includes a spring seat, said biasing means being seated against said spring seat.

9. A valve plate assembly as set forth in claim 8 wherein said conical surface is inclined at an angle of approximately 45° relative to the axis of said discharge passage.

10. A valve plate assembly as set forth in claim 1 wherein said sidewall and said conical surface are in generally parallel relationship and provide approximately a 10° parallel wall diffuser.

* * * * *

UNITED STATES PATENT AND TRADEMARK OFFICE

CERTIFICATE OF CORRECTION

PATENT NO. : 4,469,126

DATED : September 4, 1984

INVENTOR(S) : Francis M. Simpson

It is certified that error appears in the above-identified patent and that said Letters Patent is hereby corrected as shown below:

On the title page under U.S. References cited Insert:

| | | |
|---|---|---|
| 1,136,840 | 4/1915 | Shaw |
| 867,702 | 10/1907 | Clarke |

Column 3, lines 21 and 22, "inserting" should be
-- insuring --.

Signed and Sealed this

Twenty-sixth Day of February 1985

[SEAL]

*Attest:*

DONALD J. QUIGG

*Attesting Officer* *Acting Commissioner of Patents and Trademarks*